US007497773B1

(12) United States Patent
Schmidt

(10) Patent No.: US 7,497,773 B1
(45) Date of Patent: Mar. 3, 2009

(54) CEILING MOUNTED FAN VENTILATION DEVICE

(76) Inventor: Gary D. Schmidt, 4440 Kelly Dr., Richardson, TX (US) 75082

( * ) Notice: Subject to any disclaimer, the term of this patent is extended or adjusted under 35 U.S.C. 154(b) by 453 days.

(21) Appl. No.: 10/702,245

(22) Filed: Nov. 6, 2003

(51) Int. Cl.
*F24F 7/06* (2006.01)
*F24F 13/08* (2006.01)

(52) U.S. Cl. ..... 454/354; 182/77; 454/349

(58) Field of Classification Search ..... 454/346, 454/349, 353, 354, 355; 182/77; 236/49.3
See application file for complete search history.

(56) References Cited

U.S. PATENT DOCUMENTS

| | | | | |
|---|---|---|---|---|
| 2,084,807 | A | 6/1937 | Hueglin | |
| 2,134,142 | A * | 10/1938 | Orear | 454/346 |
| 2,278,581 | A | 4/1942 | Dexter | |
| 2,496,773 | A | 2/1950 | Brown | |
| 2,746,674 | A * | 5/1956 | Alldritt et al. | 416/170 R |
| 3,326,113 | A | 6/1967 | Smith et al. | |
| 3,934,494 | A | 1/1976 | Butler | |
| 4,055,113 | A | 10/1977 | Monroe | |
| 4,201,121 | A | 5/1980 | Brandenburg, Jr. | |
| 4,251,026 | A | 2/1981 | Siegel et al. | |
| 4,261,255 | A | 4/1981 | Anderson et al. | |
| 4,280,399 | A | 7/1981 | Cunning | |
| 4,286,508 | A | 9/1981 | Seebo, II | |
| 4,501,194 | A | 2/1985 | Brown | |
| 4,770,087 | A | 9/1988 | Danley et al. | |
| 4,776,385 | A | 10/1988 | Dean | |
| 4,784,049 | A | 11/1988 | Steiner et al. | |
| 5,123,876 | A * | 6/1992 | McCullough | 454/343 |
| 5,330,386 | A | 7/1994 | Calandra | |
| 5,816,909 | A * | 10/1998 | Wunder | 454/341 |
| 5,971,848 | A | 10/1999 | Nair et al. | |
| 6,019,677 | A * | 2/2000 | Demster | 454/290 |
| 6,220,956 | B1 | 4/2001 | Kilian et al. | |
| 6,524,181 | B2 | 2/2003 | Wasson | |
| 2003/0068972 | A1 * | 4/2003 | Snyder | 454/330 |
| 2003/0159802 | A1 | 8/2003 | Steneby et al. | |

* cited by examiner

*Primary Examiner*—Gregory A Wilson
(74) *Attorney, Agent, or Firm*—Gerard Moy; Robert E. Wise

(57) ABSTRACT

A ceiling mounted fan ventilation device moves a fresh inflow of air from within a room such as a garage to said attic thereof in an effective manner in order to mitigate the climatic effects on the room due to adverse ambient conditions. The device is not only capable of moderating the temperature of the room, but also augments the existing ventilation system for the attic enclosure. The device may utilize the existing hole of an attic access means such as a disappearing stairway or scuttle hole thus negating the need for extensive modifications to an existing ceiling structure. Alternatively, a method is disclosed herein whereby the fan ventilation device may be mounted directly to the ceiling portion of the room. The device may be implemented in any type of room wherein it is desirous to maintain a fresh flow of air therethrough.

16 Claims, 4 Drawing Sheets

CEILING MOUNTED FAN VENTILATION DEVICE

CROSS-REFERENCE TO RELATED APPLICATIONS

Not applicable.

FIELD OF THE INVENTION

This invention relates to fan ventilation devices, and more particularly, to a ceiling mounted fan ventilation device which is capable of mitigating the climatic conditions within the room of an architectural structure as well as the attic enclosure thereof via a controlled inflow of fresh ambient air thereinto.

BACKGROUND OF THE PRIOR ART

Many homes today have a garage that is constructed as an integral part of a home's structure. This architecture creates an aesthetically pleasing design for the home as well as to provide an easy means of moving from the automobile into the home. For single story homes having a conventional garage that is adjoined to the living quarters of a home, the roof thereabove in conjunction with a ceiling creates an attic enclosure which is commonly shared thereby. Although used primarily for the storage of automobiles, the garage is also used for the storage of other various household items such as lawn care equipment, shop tools, and the like.

Nevertheless, to further increase the available storage capacity of household items, many homes nowadays have an attic access means which is accessible from the garage enclosure. This attic access means may be a conventional disappearing stairway which comprises a folding ladder for entry into the attic enclosure. The folding ladder is hingibly attached to one end of a rectangular shaped hole in the ceiling for reciprocal movement from a contracted position within the confines of the attic enclosure to an extended position wherein a user may enter the attic by climbing thereon. The rectangular shaped hole is formed from adjacent joists of the attic floor and cross braces that extend therebetween. The disappearing stairway typically includes a flat panel that lies generally flush with the ceiling when in the contracted position to inhibit airflow from the garage to the attic as well as to enhance the general appearance thereof. Another type of attic access means which is commonly used is a generally rectangular shaped hole in the ceiling having a flat panel which is laid over the opening thereof commonly known as a scuttle hole. The scuttle hole is similar to a disappearing stairway in that the rectangular shaped hole is formed from adjacent joists of the attic floor in conjunction with cross braces therebetween. However, the scuttle hole differs from the disappearing stairway in that no folding ladder for climbing into the attic is provided, only a flat panel of a predetermined size for covering the hole is removably disposed thereover when not in use. In addition, the lateral dimensions of the rectangular shaped hole are chosen to allow entry to the attic space by one person at a time.

Because the attic enclosure exists as a generally confined area between the roof structure and the ceiling, temperatures therein can become excessive during the summer months. Similarly, the conventional garage encompasses a confined air space due to current building practices which do not provide for adequate ventilation of the garage enclosure. Thus, the conventional garage is rarely designed to be protected from the thermal elements of nature because it is understood that home dwellers rarely spend significant amount of time therein. Therefore, the temperatures within a conventional garage can become very hot during the summer months. This problem is exacerbated by current building practices in which the ceiling or the walls of a garage of a home are not insulated, as is the rest of the home.

In many cases, it would be desirable to provide ventilation from a room such as a garage to the attic in order to maintain a fresh inflow of air to the room as well as to the attic enclosure. This would be particularly advantageous during the summer months when temperatures in poorly ventilated rooms or attics can become very hot. Nevertheless, there has heretofore been no device proposed that can be implemented on the ceiling of a room without significant modification to the ceiling structure. U.S. Pat. No. 4,261,255 to Anderson et al., U.S. Pat. No. 4,501,194 to Brown and, U.S. Pat. No. 4,784,049 to Steiner et al. disclose examples of fan devices which are designed to move air from a room into an attic. Nevertheless, all of these devices require a dedicated hole be cut into a ceiling as well as other structural modifications which are outside the scope or capabilities of the standard homeowner. Thus, these devices require professional installation, which is costly. U.S. Pat. No. 5,330,386 to Calandra proposes a ventilation device which passively moves air through the flat panel of a scuttle hole. However, since this device depends upon the airflow created by fans mounted on the roof of a home, sufficient airflow is not created in order to appreciably lower the temperature in a room such as a garage due to other vent structures such as soffit vents which also draft air into the attic enclosure. Moreover, current building practices have implemented ventilation mechanisms which overlay the ridge of a typical roof commonly known as "ridge vents" and examples of such devices are disclosed in U.S. Pat. No. 3,326,113 to Smith et al., U.S. Pat. No. 4,280,399 to Cunning, and U.S. Pat. No. 5,971,848 to Ravinder et al. Because these devices move air through an attic enclosure in a passive manner, the airflow required to effectively lower the temperatures of a room such as a garage are not attainable when used in conjunction with the '386 device.

The need to provide active ventilation for a garage structure has been known. For example, U.S. Pat. No. 6,524,181 to Wasson discloses a fan device which may be mounted to either the garage door or wall of a garage. However, neither fan mounting location is capable of augmenting the existing ventilation system of the attic enclosure. In addition, the structural configuration of the walls of a typical garage is not conducive to an easy installation procedure which requires the cutting of a hole therein. Moreover, the routing of power cables to the fan device that is mounted on a garage door is cumbersome.

Various attempts have been made to utilize the existing opening in a ceiling provided by a disappearing stairway to vent air from a room to the attic via a fan means. U.S. Pat. No. 2,496,773 to Brown discloses a disappearing stairway having a louvered panel which allows airflow to pass therethrough when in the contracted position. Nevertheless, this device also requires the use of a large, movable shroud to direct airflow from the horizontally oriented louver structure to a vertically oriented fan disposed in the attic. U.S. Pat. No. 4,286,508 to Seebo discloses a combination disappearing staircase/attic fan means arrangement wherein either device may be alternatively positioned over a hole in the ceiling. Nevertheless, both the disappearing stairway as well as the attic fan means are relatively large, heavy devices which would be cumbersome to move. In addition, the use of either device is mutually exclusive, that is both devices cannot be used at the same time.

There has been a long-felt need for a ventilation device for any room of a house or other similar type building which utilizes the existing hole of an attic access means disposed in a ceiling thereof to provide positive ventilation of air from the room to the attic thereabove by a fan means. The device should provide adequate ventilation to effectively lower the temperature thereof during the hot summer months, and should be easy to install and maintain by a relatively unskilled homeowner.

SUMMARY OF THE INVENTION AND OBJECTIVES

The present invention provides a solution to these as well as other needs via a ceiling mounted fan ventilation device which moves a fresh inflow of air from within a room to the attic thereof in an effective manner in order to mitigate the climatic effects on the room due to adverse ambient conditions. The fan ventilation device includes an integrally mounted thermostat to automatically turn on the fan when the ambient climate of the room needs to be moderated and turn off the fan when not needed. The device may utilize the existing hole of an attic access means such as a disappearing stairway or scuttle hole thus negating the need for extensive modifications to an existing ceiling structure. Alternatively, a method is disclosed herein whereby the fan ventilation device may be easily mounted directly to the ceiling portion of the room. Although the disclosure of the present invention is directed to a garage of a home, it is well known in the art that the present invention may be implemented in any room of any structure having an attic enclosure such as warehouses, barns, sheds, animal enclosures, prefabricated trailers, detached garages, commercial structures, outbuildings, and the like. Therefore, all of the aforementioned structures having a room to be ventilated will hereinafter be referred to as architectural structures throughout the remainder of this document.

The present invention generally comprises a fan arrangement which is mounted to any flat surface such as a ceiling or flat panel of an attic access means therebeneath. A hole exists in the flat surface directly above the fan arrangement to allow the free movement of air from the room into the attic enclosure. The fan arrangement is powered using standard electrical power and is controlled via a thermostat which turns the fan on when the temperature in the room exceeds a user-specified threshold and turns off when the temperature drops below the threshold including some amount of hysterisis. Optionally, but not by way of limitation, the fan arrangement may also be controlled by a humidistat or other humidity controlling means. Another alternative embodiment which is within the scope of the present invention contemplates a fan device which is selectively reversible in direction, thus providing for forced airflow from the room into the attic or conversely, from the attic to the room.

One aspect of the present invention is an easily implemented, cost-effective method of cooling a room during the hot summer months. Because some rooms such as garages have inherently poor ventilation, the temperatures therein will exceed the outside ambient temperature. The present invention solves this problem by creating a steady inflow of fresh, cooler outside air into the room. Moreover, a thermostatic switch alleviates the need for the user to manually turn the device on and off due to ever changing ambient conditions. Optionally, a humidistat or other humidity controlling means may be included to insure that overly humid air does not stagnate in the room or attic enclosure and thus precipitate as water therein.

Another aspect of the present invention is a means to aid the existing ventilation system for the attic enclosure. Virtually all architectural structures currently have some means of circulating fresh air through an attic enclosure. Nevertheless, the incremental increase in air circulation in the attic enclosure due to the operation of the present invention would serve to further enhance the existing ventilation system's effects, particularly during the hot summer months when temperatures in attics can become very hot.

It is therefore an object of the present invention to provide a ceiling mounted fan ventilation device to any room for which it is desirous to maintain a fresh inflow of air thereto.

A further object of the present invention to provide a ceiling mounted fan ventilation device to any room having an attic access means such as a disappearing stairway or scuttle hole for ease of installation.

A further object of the present invention to provide a ceiling mounted fan ventilation device which moderates the temperature or humidity of a room by the forced circulation of fresh air therethrough.

A further object of the present invention to provide a ceiling mounted fan ventilation device which moderates the temperature or humidity of an attic enclosure by the forced circulation of fresh air thereinto.

A further object of the present invention to provide a ceiling mounted fan ventilation device, wherein said fan ventilation device is thermostatically controlled to alleviate the user's need for manual manipulation of said device.

A further object of the present invention to provide a ceiling mounted fan ventilation device, wherein said fan ventilation device is humidistatically controlled to alleviate the user's need for manual manipulation of said device.

A further object of the present invention is to provide a ceiling mounted fan ventilation device, wherein said fan ventilation device is selectively reversible in order to provide for forced airflow from the room into the attic enclosure, or conversely, from the attic enclosure into the room.

Another object of the present invention to provide a ceiling mounted fan ventilation device which is easy to install and maintain by a relatively unskilled homeowner.

These and other objects will become readily apparent to those familiar with the construction and use of ventilation devices and will become apparent in the following portions of the specification, wherein the detailed description is for the purpose of fully disclosing preferred embodiments of the invention without placing limitations thereon.

BRIEF DESCRIPTION OF THE DRAWINGS

For a more complete understanding of the present invention, and the advantages thereof, reference is now made to the following descriptions taken in conjunction with the accompanying drawings in which.

DETAILED DESCRIPTION OF THE PREFERRED EMBODIMENTS

Figure 1:
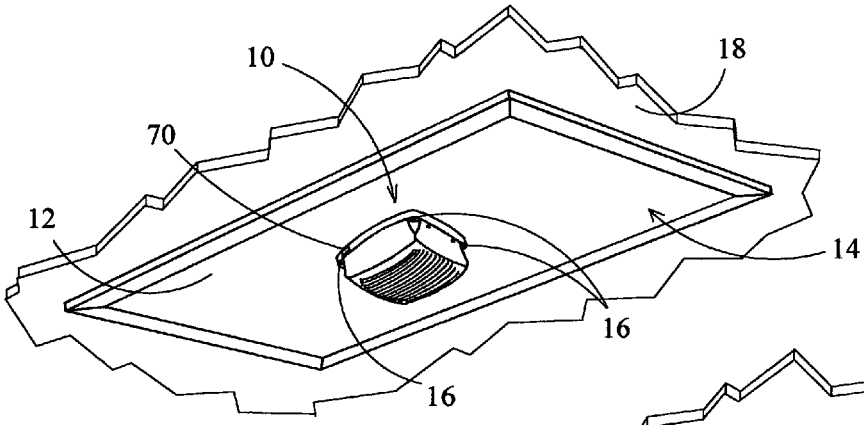
FIG. 1 is a perspective view of a preferred embodiment of the present invention mounted in operative engagement on the panel of a conventional disappearing stairway which is in the contracted position.
Figure 2:
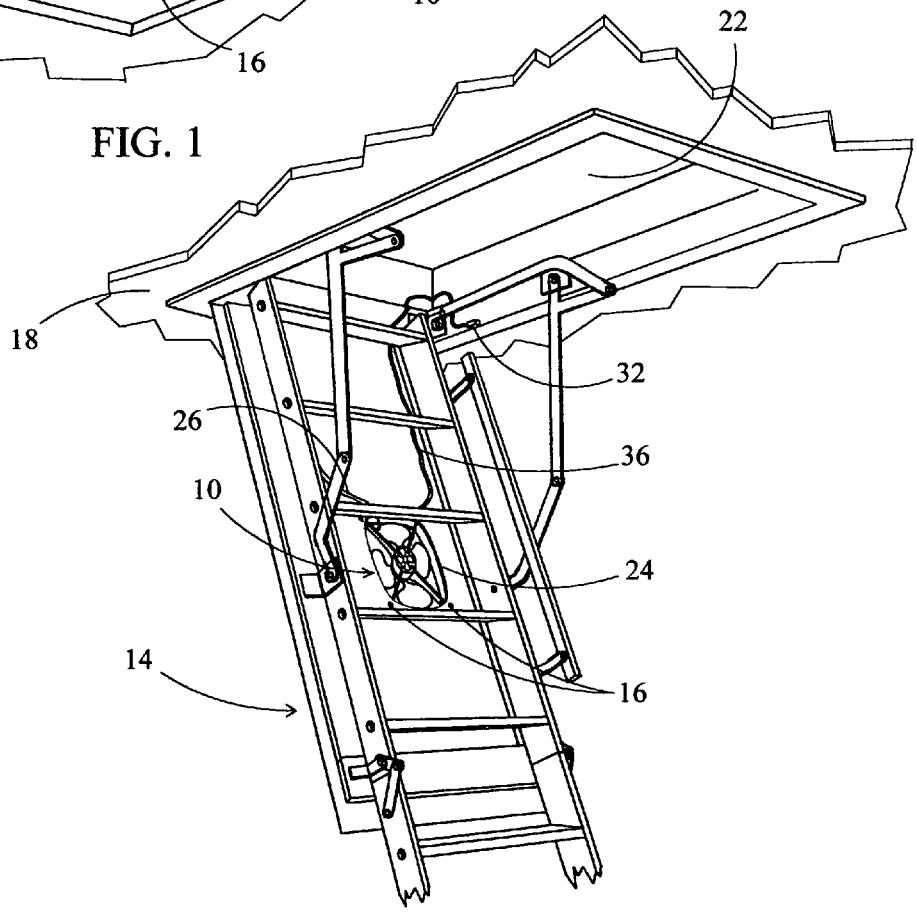
FIG. 2 is a perspective view of the embodiment of FIG. 1 shown mounted in operative engagement on the panel of a conventional disappearing stairway which is in the extended position.
Figure 3:
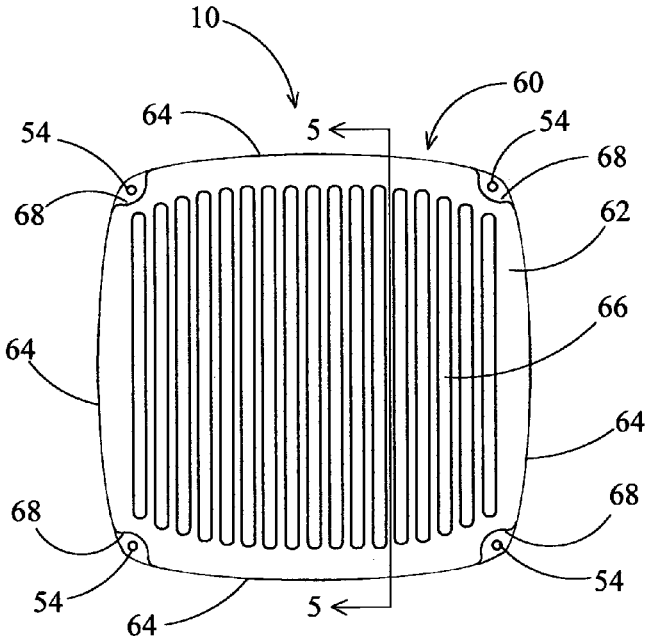
FIG. 3 is a bottom view of the embodiment of FIG. 1.
Figure 4:
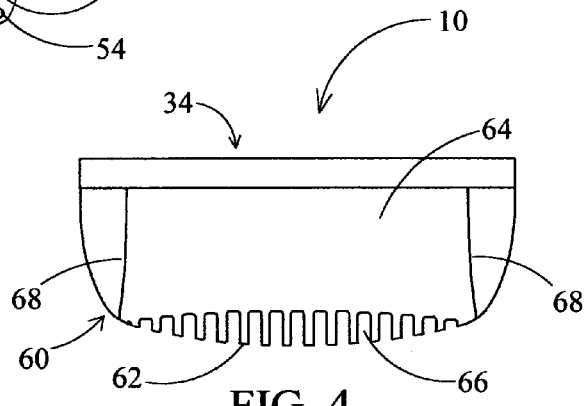
FIG. 4 is a side view of the embodiment of FIG. 1.
Figure 5:
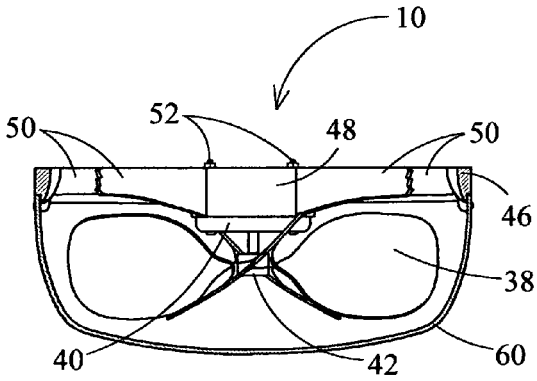
FIG. 5 is side sectional view taken at 5—5 of the embodiment of FIG. 1 showing the arrangement of the impeller, motor, fan housing, and fan base.
Figure 6:
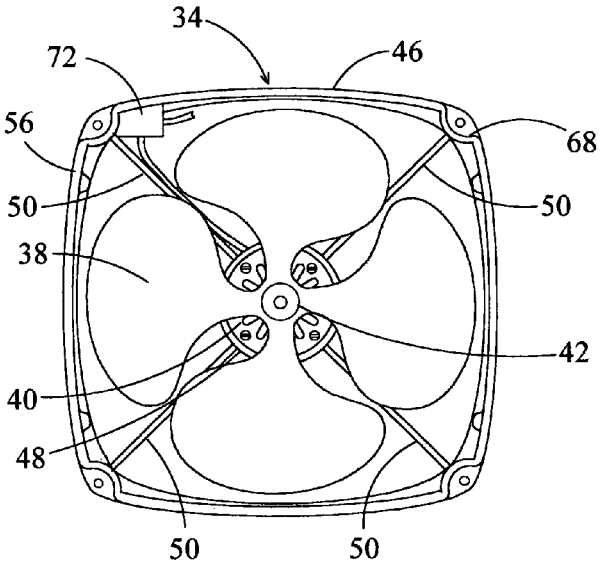
FIG. 6 is a bottom view of the embodiment of FIG. 1 shown with the fan housing removed.

Referring now to the drawings, FIGS. 1 and 2 show a fan ventilation device 10 in operative engagement mounted beneath the flat panel 12 of a conventional disappearing stairway 14. As can be seen, the fan ventilation device 10 is unobstructive to the normal use of the disappearing stairway 14 and adds an aesthetically appealing finish to bottom surface of the stairway's panel 12. The fan ventilation device 10 is secured to the panel 12 which is typically made of one-quarter to one-half inch thick plywood using standardly available bolts 16 and associated nuts. As shown in FIG. 1, the flat panel 12 lies essentially flat with the ceiling 18 while the disappearing stairway 14 is in the contracted position and thus creates a generally airtight fit over the stairway hole 22 with the exception of a fan hole 24 which is to be described later. FIG. 2 shows the stairway 14 in the extended position in order to reveal the top portion of the fan 10 as seen through the fan hole 24. Electrical power is provided to the fan 10 via electrical power cables 26 and is controlled by a thermostat 70 which senses the temperature of the room. A microswitch 32 is provided which is closed when the stairway 14 is in the contracted position and open when the stairway is moved to the extended position. The microswitch 32 is connected to the wiring of the fan device 10 via electrical cables 36 in a series type connection in order to automatically interrupt electrical power to the fan device 10 when the stairway 14 is drawn to the extended position by a user.

A first embodiment of the present invention designated generally by reference numeral 10 is shown in greater detail in FIGS. 3 through 6. The fan ventilation device 10 is generally shown having a fan base 34, a fan housing 60, and a four-bladed impeller 38 which is secured to the output shaft of an electric motor 40. The impeller 38 comprises four blades which are attached to an impeller hub 42 and are oriented such that airflow created thereby is directed upward toward the fan base 34.

The fan base 34 includes an annular ring 46 for structural support of the fan device 10 and a cup-shaped motor mount 48 which is securely suspended in the center thereof by four generally flat shaped motor support members 50. The motor support members each defining a rectangular, solid cross-section are oriented such that the lateral dimension thereof is thin relative to its height in order to minimize any obstruction to the airflow therethrough. The motor mount 48 is dimensioned to fit snugly around the upper periphery of the motor 40 and is secured thereto using motor mount bolts 52 and associated nuts. The annular ring 46 is fashioned in a generally square configuration whose sides thereof are arcuate in shape. Each of the corners of the annular ring 46 has an aperture 54 to accept a standard bolt for mounting to the lower surface of a ceiling or flat panel 12 of a disappearing stairway or scuttle hole. An indentation 56 exists around the entire periphery of the fan base 34 which is sized to provide a snug fit for the top edge the fan housing 60 to be described hereinbelow.

The fan motor 40 is controlled by a conventional thermostat 70 that is electrically connected thereto via a series connection and is encased within the confines of a thermostat housing 72. The thermostat 70 controls the operation of the fan motor 40 as a function of temperature to set the turn-on and turn-off temperature thresholds at which the motor is activated. Alternatively, the thermostat 70 may also be coupled with a humidistat which would activate the fan motor 40 depending upon the humidity levels in the room. Alternatively, the fan motor may be of a selectively reversible type; that is, a switch (not shown) may exist on the motor housing or fan base which is switchable between an upward directing airflow and a corresponding downward directing airflow caused by the fan when in operation. The annular ring 46, motor mount 48, support members 50, and thermostat housing 72 are integrally formed of high impact plastic or the like type material.

A fan housing 60 made from high impact plastic is included for protection of the impeller 38 during operation is releasably mounted to the fan base 34 using screws or other suitable releasable attachment mechanism. The fan housing 60 is essentially box-like in shape having a bottom wall 62 and four integrally extending sidewalls 64 each having a generally convex surface. A plurality of elongated holes 66 exists in the bottom wall 62 of the fan housing 60 in order to allow relatively unrestricted airflow therethrough. Depressions 68 exist the corners of the fan housing 60 in order to provide access to the four apertures 54 of the fan base 12.

Figure 7:
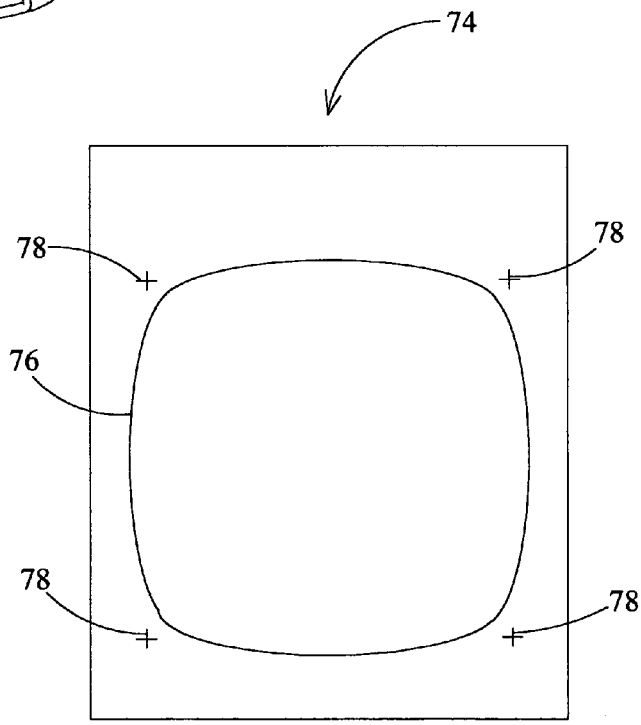
FIG. 7 is a plan view of a cutout template for use with the embodiment of FIG. 1.
Figure 8:
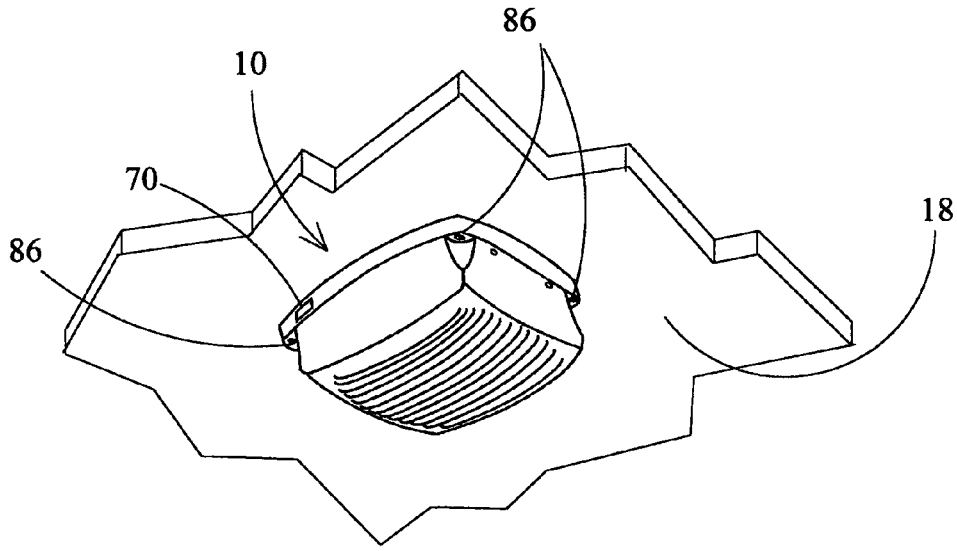
FIG. 8 is a perspective view of an alternate mounting means for the embodiment of FIGS. 3 through 6 showing the present invention mounted in operative engagement directly onto the ceiling of a room.

The method of operation of the attic access means mounted fan ventilation device will now be described. A cutout template 74 as shown in FIG. 7 is provided which contains indicia thereon for easy forming of the fan hole 24 as well as fan mounting holes (not shown) in the panel 12 of a disappearing stairway by a user. The indicia includes a printed marking 76 which represents the size and shape of the fan hole 24 to be cut into the panel 12 by the user and crosses 78 which represents the relative centers of fan mounting holes to be cut into the panel 12 for receipt of the mounting bolts 16. The template 74 is temporarily secured to the lower surface of the panel 12 using conventional thumb-tacks, tape, or the like and the fan hole 24 and fan mounting holes made at the appropriate locations. Next, the fan device 10 is mounted to the panel 12 using bolts 16 and their associated nuts and the electrical cabling wired to an appropriate source of electrical power. To insure the availability of airflow into the room, a window may be opened or if the present embodiment is to be used in a conventional garage, a garage door opened slightly. In operation, when the temperature in the room increases beyond the turn-on threshold of the thermostat 70, the fan will turn on and begin to create airflow from the room into the attic. Once the temperature of the room has been lowered to a point below a predetermined turn-off threshold, typically below the turn-on threshold, the fan motor will turn off. Alternatively, if the fan device contains a humidistat, the fan will turn on when the humidity in the room exceeds a predetermined humidity threshold level and will turn back off when a second humidity threshold level has been reached. In addition, microswitch 32 insures that the fan device 10 is turned off when the stairway 14 is moved to the extended position for access to the attic enclosure by a user. Thus, when the stairway 14 is moved to the extended position by a user, the microswitch 32 opens thus interrupting power to the fan device 10. Conversely, when the stairway 14 is again moved to the contracted position, the microswitch 32 is closed and normal operation of the fan device 10 resumes.

Figure 9:
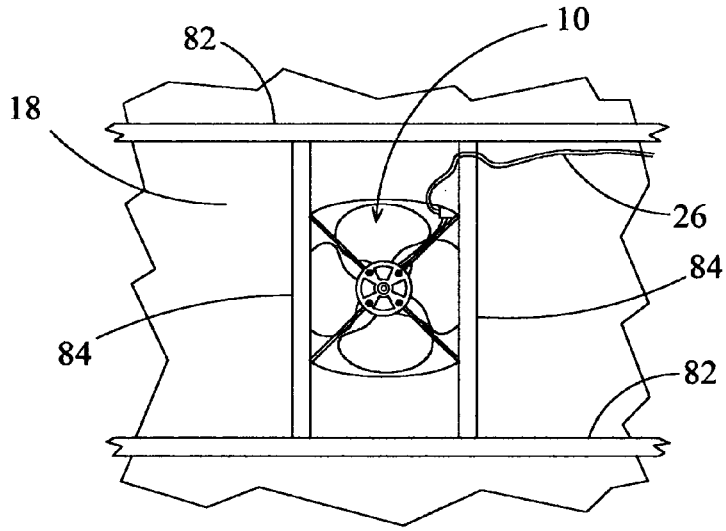
FIG. 9 is a plan view of the alternate mounting means of FIG. 8 showing the present invention mounted in operative engagement directly onto the ceiling of a room.

An alternative method of operation of the present invention on the upper surface of a room such as a garage contemplates mounting of the fan device 10 directly onto the ceiling thereof as shown in FIGS. 9 and 10. This alternative method of operation utilizes the fan device 10 as described hereinabove and includes similar steps of electrical wiring to the fan motor, insuring the availability of airflow into the room, as well as the operation of the thermostat/humidistat are functionally similar to the previously described method of operation. The essential difference being the mounting means of the fan device 10 as described hereinbelow. It is important to note that the microswitch 32 and electrical cable assembly 36 is not needed with this mounting configuration as no disappearing stairway 14 is used in this method of operation. To mount the fan device 10 directly to the ceiling 18, the cutout template 74 is temporarily secured to an appropriate location, preferably between two adjacent joists 82, on the bottom surface of the ceiling. Any obstructions on the upper surface of the ceiling such as wires or insulation are removed and then the fan hole 24 and fan mounting holes are made in the ceiling along printed marking 76 and crosses 78 respectively. Elongated cross members 84 made of commonly available lumber, preferably two-by-four studs are cut to an appropriate length to span the entire distance between the two adjacent joists 82. Each cross member is placed over the fan mounting holes and permanently secured into position using nails. Next, the fan device 10 is mounted to the ceiling 18 using conventional screws 86 that are inserted through apertures 54 and secured to the cross members 84 thereabove.

It should be noted that the present method of operation may also be implemented on rooms of an architectural structure having another room disposed thereabove such as a structure commonly known as a two-story building. This type of architectural structure most commonly provides structural support for the floor of the second story via joists (not shown) which extend vertically from the ceiling of the room of the first floor to the floor of the second floor. The joists in conjunction with the first floor ceiling, and second story floor define a ventilation space for conveying airflow from the fan hole 24 therethrough. Air vents (not shown) may be provided on the walls of the structure to allow the relatively free movement of air from the ventilation space to the outside environment.

The present invention may be embodied in other specific forms without departing from the spirit or scope of the invention. For example, it is well known in the art that in addition to the axial-throughput type impeller described hereinabove, there are other types of impeller devices such as the squirrel cage type impeller which could be implemented within the present invention without departing from the spirit or scope of the invention. For example, it is well known in the art that there are a myriad of varying fan devices that are designed to move air from one location to another, and any of these air moving means may be implemented in the present invention for the purpose of mounting on the ceiling portion of a garage or other similar room for the purpose of drawing cooler, fresh air from the outside and exhausting this air into the attic for seasonal cooling thereof under thermostat control. Therefore, the described embodiments are to be considered in all respects only as illustrative and not restrictive. The scope of the invention is therefore, indicated by the appended claims rather than by the foregoing description. All changes which come within the meaning and range of equivalency of the claims are to be embraced within their scope.

I claim:

1. A method for the moderating the climate of a generally enclosed room of an architectural structure, said architectural structure having a roof and a ceiling defining an attic enclosure therebetween and wherein said ceiling partitions said attic enclosure from said room of climate to be moderated, said ceiling having an attic access means for access to said attic enclosure by a user wherein said attic access means is disposed within a rectangular shaped hole in said ceiling, said attic access means includes a flat panel for selectively covering said rectangular shaped hole wherein said panel lies generally flush with said ceiling when selectively covered, said method comprising:

providing a fan ventilation device having a fan which is electrically operable to create an airflow from said room to said attic enclosure, said fan is adapted to be mounted to said panel, said fan comprising an impeller having at least one blade for the forced movement of said airflow, an electric motor having electrical cables, said motor being mechanically connected to said impeller for rotational movement thereof, and a fan base for structural support of said fan device, said fan base includes a motor mount for mounting of said electric motor, and climate regulating means which operates to turn on said motor when climatic conditions within said room exceed a first predetermined level and to turn off said motor when climatic conditions within said room drop below a second predetermined level, whereby said climate regulating means automatically controls the operation of said fan in order to alleviate a user's need for manual manipulation of said fan, cutting a hole through the panel of said attic access means of a size and shape sufficient to allow said airflow to flow freely from said room into said attic enclosure, mounting said fan ventilation device to said panel substantially over said hole of said panel such that said airflow created by said fan is allowed through said hole in a relatively unrestricted manner; and, connecting said electrical cables to a suitable source of electrical power.

2. The method of claim 1, further comprising the step of connecting a microswitch to the electrical cables of said electric motor via a series connection in order to automatically interrupt electrical power to said electric motor when said stairway is drawn to the extended position by a user.

3. The method of claim 1, wherein said attic access means is a conventional scuttle hole.

4. The method of claim 1, wherein said attic access means is a conventional disappearing stairway.

5. The method of claim 1, wherein said room is a garage enclosure.

6. The method of claim 1, wherein said climate regulating means is a conventional thermostat for the moderation of temperature in said room.

7. The method of claim 1, wherein said climate regulating means is a conventional humidistat for the moderation of humidity in said room.

8. A fan ventilation device for moderating the climate of a generally enclosed room of an architectural structure, said architectural structure having a roof and a ceiling defining an attic enclosure therebetween and wherein said ceiling partitions said attic enclosure from said room of climate to be moderated, said fan ventilation device comprising:

an attic access means for access to said attic enclosure by a user wherein said attic access means is disposed within a rectangular shaped hole in said ceiling, said attic access means includes a flat panel for selectively covering said rectangular shaped hole wherein said panel lies generally flush with said ceiling when selectively covered, said panel having an air hole therein to permit the easy flow of air therethrough by, a fan which is electrically operable to create an airflow from said room to said attic enclosure, said fan is mounted to said panel and is disposed thereon such that said airflow is allowed to move through said air hole in a relatively unrestricted manner, said fan comprising:

an impeller having at least one blade for the forced movement of said airflow through said air hole, an electric motor which is connected to said impeller for rotational movement thereof, and a fan base for structural support of said fan device, said fan base includes a motor mount for mounting of said electric motor substantially over said air hole, and climate regulating means which operates to turn on said motor when climatic conditions within said room exceed a first predetermined level and to turn off said motor when climatic conditions within said room drop below a second predetermined level, whereby said climate regulating means automatically controls the operation of said fan in order to alleviate a user's need for manual manipulation of said fan.

9. The fan ventilation device of claim 8, wherein said attic access means is a conventional scuttle hole.

10. The fan ventilation device of claim 9, wherein said fan ventilation device further includes a microswitch which is connected to the electrical cables of said electric motor via a series connection in order to automatically interrupt electrical power to said electric motor when said stairway is drawn to the extended position by a user.

11. The fan ventilation device of claim 8, wherein said attic access means is a conventional disappearing stairway.

12. The fan ventilation device of claim 8, wherein said room is a garage enclosure.

13. The fan ventilation device of claim 8, wherein said climate regulating means is a conventional thermostat for the moderation of temperature in said room.

14. The fan ventilation device of claim 8, wherein said climate regulating means is a conventional humidistat for the moderation of humidity in said room.

15. The fan ventilation device of claim 8, wherein said architectural structure is a building selected from the list consisting of homes, warehouses, barns, sheds, animal enclosures, prefabricated trailers, detached garages, commercial structures, and outbuildings.

16. The fan ventilation device of claim 8, wherein said electric motor is selectively reversible in rotational direction via a manually operated switch, said manually operated switch is mounted on said electric motor, said first rotational direction causes said impeller to force airflow from said room into said attic enclosure and said second rotational direction causes said impeller to force airflow from said attic enclosure to said room.

* * * * *